US005927767A

United States Patent [19]

Smith et al.

[11] Patent Number: 5,927,767

[45] Date of Patent: Jul. 27, 1999

[54] WINDOW LOCKING SYSTEM

[75] Inventors: Michael D. Smith, Rockford; William R. Kuersten, Pecatonica; Scott J. Rote, New Lenox; William M. Martz, Rockford, all of Ill.

[73] Assignee: Newell Operating Company, Freeport, Ill.

[21] Appl. No.: 08/740,747

[22] Filed: Nov. 1, 1996

[51] Int. Cl.[6] ..... E05C 1/06

[52] U.S. Cl. ..... 292/158; 292/DIG. 20; 292/139; 292/146; 292/DIG. 33; 49/279

[58] Field of Search ..... 292/156, 158, 292/157, 161, 139, 143, 146, 190, DIG. 20, DIG. 33; 49/395, 394, 279

[56] References Cited

U.S. PATENT DOCUMENTS

| | | |
|---|---|---|
| 444,869 | 1/1891 | Zimmerman . |
| 552,950 | 1/1896 | Abbott et al. . |
| 718,101 | 1/1903 | Decker . |
| 1,019,623 | 3/1912 | Fleming et al. . |
| 1,116,617 | 11/1914 | Page . |
| 1,131,247 | 3/1915 | Kiekert . |

(List continued on next page.)

FOREIGN PATENT DOCUMENTS

| | | | |
|---|---|---|---|
| 744.370 | 10/1932 | France . | |
| 1293217 | 4/1962 | France | 292/160 |
| 2032517 | 1/1972 | Germany | 292/DIG. 20 |
| 2142976 | 3/1973 | Germany | 292/DIG. 20 |
| 2 341 263 | 8/1973 | Germany . | |
| 226785 | 6/1990 | Germany . | |
| 2 175 631 | 12/1986 | United Kingdom . | |
| 2283783 | 5/1995 | United Kingdom . | |

OTHER PUBLICATIONS

Shaw Zippalok, Casement Hardware by Arthur Shaw Corporation.

"AJ Handbook of Architectural Ironmongery" (Section 2) Grahame Underwood and John Planck, 1977.

"ASD Catalogue of Fittings for Windows and Doors" Archivent Sales and Developments Limited, Nov. 1971.

"Swing Fittings for Door and Window System" Worchester Parsons, undated (bearing mark "Received Nov. 27, 1987 Audrey E. Knowles Chartered Patent Agent").

Titon, "Fittings for uPVC Windows and Doors", undated (notation "Interbuild 1987 collected Nov. 23, '87").

"Jet G.U–tilt–turn gear for windows and doors in PVC" undated (bearing notation "Interbuild Nov. 29, 1985 Collected NEC").

"Favorit–KF" Bauteil Siegenia System, undated (bearing mark "Received 1 Dec. 1, 1983 Audrey E. Knowles Chartered Patent Agent").

"Catalogue Window and Door Fittings" ASD, undated (bearing mark" Dec. 6, 1979").

"FUHR DK2001" Groupco, Technical Data undated (bearing mark "Interbuild 1987 collected Nov. 23, '87").

"Centro 100K The Ultimate Hardware System for P.V.C. Windows and Balcony Doors" Roto, undated (bearing notation "Obtained Interbuild Nov. 1985.").

Fenestration, May/Jun. 1995, pp. 43.

Truth Hardware Corp., Multi–Point Locking System (installation guide), dated 1996 (pages 2.8–2.8g); document shows a multi–point locking system sold by assignee of U.S. Patent No. 5,118,145 and U.S. Patent No. 4,991,886 (both cited herein).

*Primary Examiner*—Darnell M. Boucher
*Attorney, Agent, or Firm*—Foley & Lardner

[57] ABSTRACT

An apparatus is disclosed for progressively engaging a plurality of strikes with a corresponding plurality of receivers to secure and lock a window sash to a window frame. A force transmitting device may be included with a guide forming a channel for an elongated tape transmits a horizontal movement provided by an operator mechanism into a vertical movement at a locking mechanism. The operator mechanism may include a removable bezel and a removable handle to facilitate access to the operator mechanism.

25 Claims, 14 Drawing Sheets

U.S. PATENT DOCUMENTS 1,163,795 12/1915 Voight .
1,370,109 3/1921 Hart .
2,036,151 3/1936 Lang .
2,114,645 4/1938 Van Benschoten .
2,136,812 11/1938 Carnahan .
2,157,016 5/1939 Reynaud .
2,344,524 3/1944 Swann .
2,350,844 6/1944 Van Der Leun .
2,366,613 1/1945 Hagstrom .
2,369,584 2/1945 Lundholm .
2,486,407 11/1949 Hoffman .
2,569,046 9/1951 Endter .
2,716,262 8/1955 Oswald .
2,789,851 4/1957 Lickteig .
2,843,887 7/1958 Hederus .
3,032,330 5/1962 Stavenau .
3,257,755 6/1966 Lewis .
3,328,060 6/1967 Soderberg .
3,900,965 8/1975 Mummert .
3,977,711 8/1976 Lajcak .
4,003,614 1/1977 Geer et al. .
4,095,829 6/1978 Van Klompenburg .
4,244,610 1/1981 Hawkins .
4,258,946 3/1981 Angioletti .
4,302,037 11/1981 Nunez .
4,392,329 7/1983 Suzuki .
4,594,865 6/1986 Parcell .
4,610,472 9/1986 Billingsley .
4,679,352 7/1987 Bates .
4,703,960 11/1987 Lense .
4,729,584 3/1988 Beckerer, Jr. .
4,739,583 4/1988 Tönsmann et al. .
4,803,808 2/1989 Greisner .
4,807,914 2/1989 Fleming et al. .
4,840,075 6/1989 Tucker .
4,845,830 7/1989 Nolte et al. .
4,860,493 8/1989 Lense .
4,887,392 12/1989 Lense .
4,937,976 7/1990 Tucker et al. .
4,991,886 2/1991 Nolte et al. .
5,074,133 12/1991 Simoncelli .
5,083,398 1/1992 Kolbeck et al. .
5,087,087 2/1992 Vetter et al. .
5,111,615 5/1992 Kuhnt et al. .
5,118,145 6/1992 Tucker .
5,143,412 9/1992 Lindquist .
5,152,103 10/1992 Tucker et al. .
5,201,557 4/1993 Schlack .
5,219,195 6/1993 Lawrence .
5,318,333 6/1994 Dreifert .
5,329,869 7/1994 Freeman et al. .
5,370,428 12/1994 Dreifert et al. .
5,414,899 5/1995 Raetz .
5,440,839 8/1995 Piltingsrud .

FIG. 6
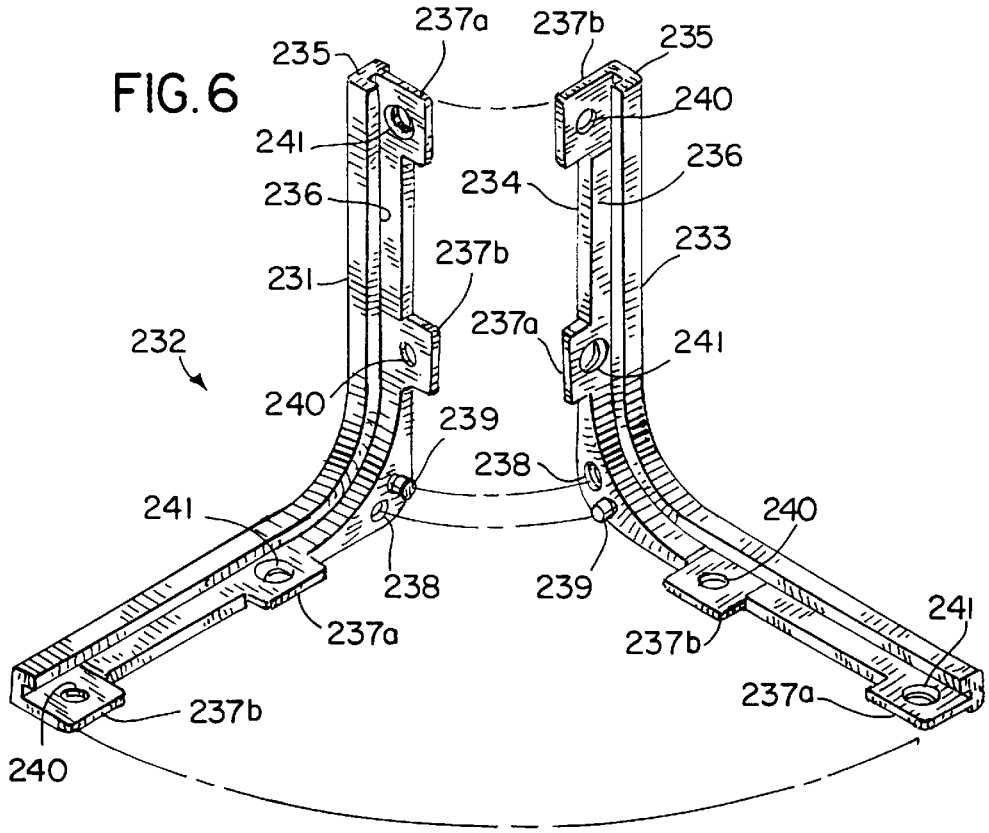
FIG. 8
FIG. 9
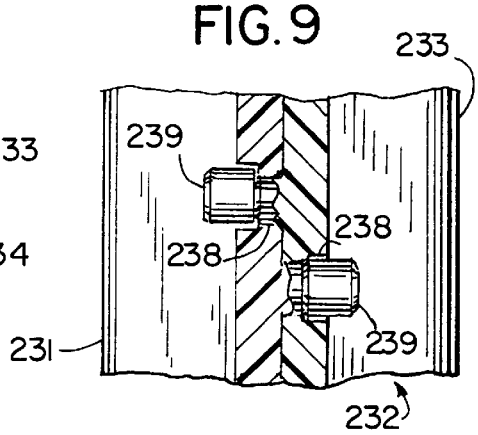
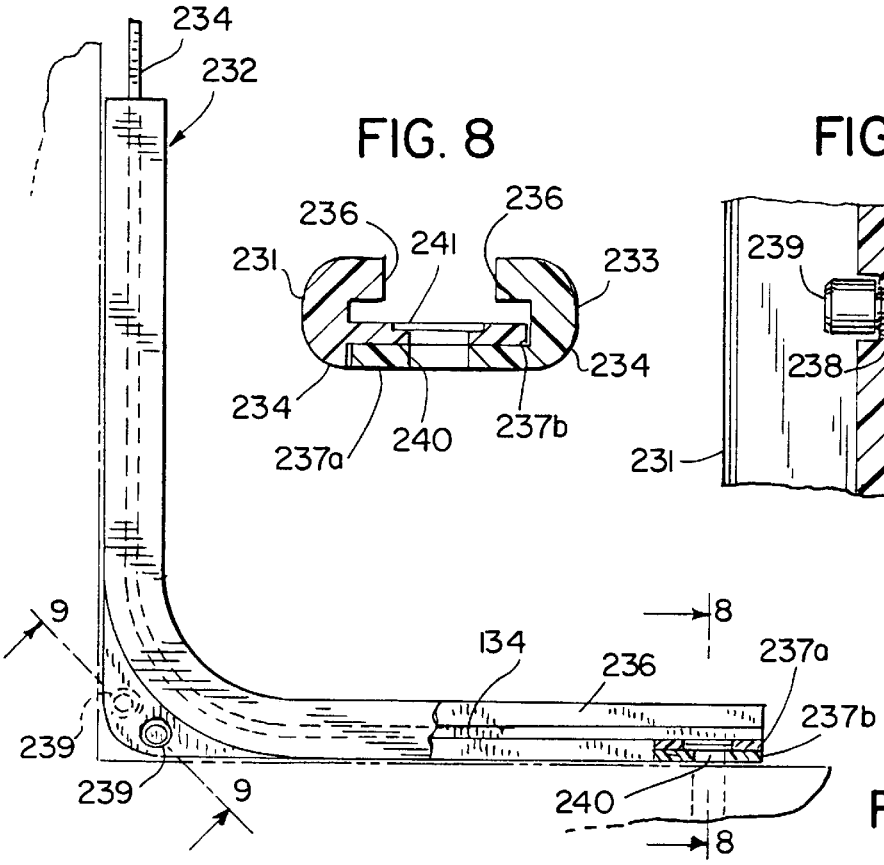
FIG. 7

FIG. 10
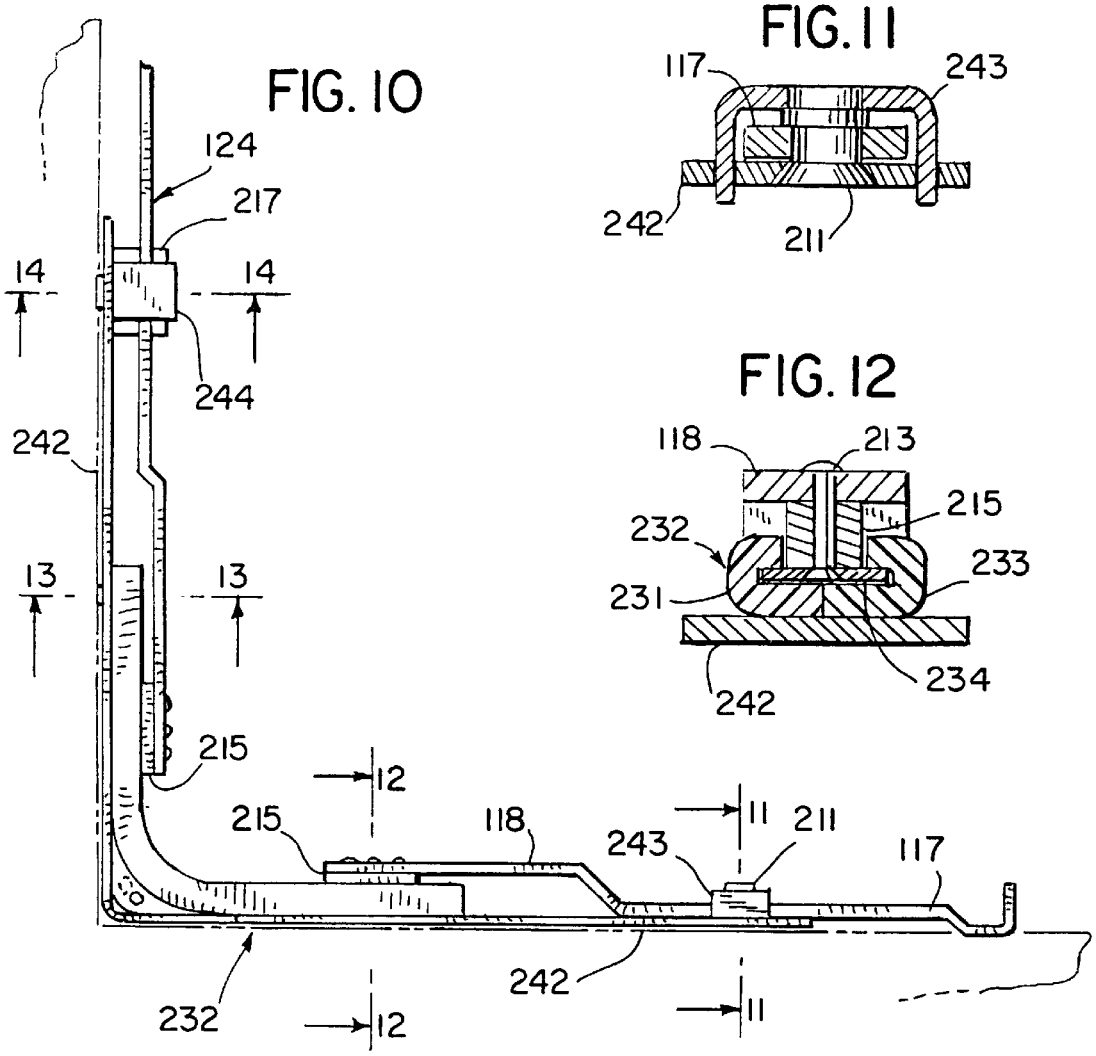
FIG. 11
FIG. 12
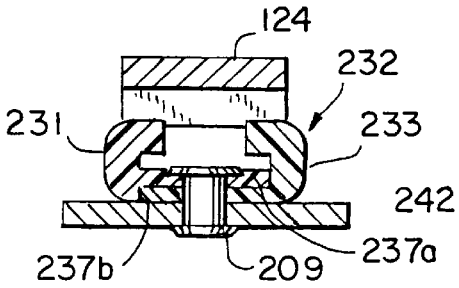
FIG. 13
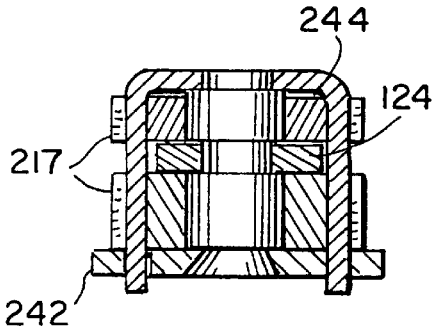
FIG. 14

WINDOW LOCKING SYSTEM

FIELD OF THE INVENTION

The present invention relates to a locking system for casement windows. In particular, the present invention relates to a locking system to secure a sash of a casement window to a window frame through progressive engagement of multiple locking points.

BACKGROUND OF THE INVENTION

Multi-point locking systems for casement windows have been provided in the past to secure a window sash to a window frame at one or more locking points (e.g. a strike and mating receiver arrangement), typically located at two points (i.e. upper and lower) along the vertical edge of the sash and frame. Such locking systems are adapted to respond to the manipulation of an operator mechanism (typically with a rotatable handle) through which an input force is applied (the operator typically being located at the side of the window frame adjacent to or between the locking points) which actuates a locking mechanism (including a lockbar and a lockbar retainer) to engage the locking points. Such locking systems may engage either all of the locking points at the same time according to a common arrangement, or each locking point sequentially, as shown in U.S. Pat. No. 4,991,886, issued to Nolte et al. and U.S. Pat. No. 5,118,145, issued to Tucker.

When simultaneous engagement of all locking points is attempted, considerable input force may be required to manipulate the handle, particularly if there is any misalignment between the sash and the frame or of the corresponding elements of one or more locking points (e.g. strikes and receivers). In addition, there is a possibility that due to misalignment (or other effects) less than all of the locking points will actually engage, which results in the incomplete "locking" of the window.

As disclosed in the Nolte patent, it has been found that the effects of misalignment may be reduced in an arrangement providing for sequential engagement of the locking points (e.g. strikes and keepers). However, in the sequential locking arrangement of the Nolte patent, which includes a set of keepers with a ramped section and generally planar section, with mating strikes mounted at varied centers (i.e. distances relative to the corresponding mating keeper), the input force required for locking may be discontinuous. Depending upon the alignment of the window or arrangement of the various locking points, greater input force may be necessary for engagement of one locking point than another.

It would be advantageous to provide a progressive multi-point locking system for a casement window offering advantages over both a conventional locking system (i.e. where all of the locking points are simultaneously engaged) and a sequential locking system (i.e. where the locking points are engaged in sequence). It would be advantageous to have a progressive locking system that readily provides for smooth and even locking action. It would also be advantageous to have a window locking system adapted for mounting of the operator mechanism (with handle) at the bottom of the frame and mounting of the locking mechanism (with locking points) at the side, including a motion translation device of relatively simple construction coupling the operator mechanism to the locking mechanism. It would further be advantageous to have an arrangement wherein it is readily possible to remove the handle and a bezel of the operator mechanism (which is secured to the frame by fasteners which are accessible from inside whether the window is in the locked or the unlocked position) to allow for repair without damaging the window or the frame.

SUMMARY OF THE INVENTION

The present invention relates to an apparatus for locking a window having a frame and a sash movable relative to the frame, with a first receiver mounted to the sash and a second receiver mounted to the sash, the first receiver having a retaining profile, a lockbar coupled to the frame and selectively movable between a locked position and an unlocked position, and a first strike mounted to the lockbar and a second strike mounted to the lockbar. The apparatus also includes an input device coupled to the lockbar adapted to selectively move the lockbar between a locked position and an unlocked position, with progressive locking of the sash to the frame being developed as the lockbar is moved from the unlocked position to the locked position, the first strike being progressively engaged and retained along the retaining profile of the first receiver, progressive locking continuing as the second receiver engages the second strike.

The present invention also relates to an apparatus for locking a window having a frame and a sash movable relative to the frame, with a first receiver mounted at a lower end of the sash and a second receiver mounted at an upper end of the sash, the first receiver having a generally arcuate retaining profile, and a lockbar coupled to the frame and selectively movable between a locked position and an unlocked position, with a first strike mounted to the lockbar at a lower end of the frame and a second strike mounted to the lockbar at an upper end of the frame. The apparatus also includes an operator mechanism coupled to the lockbar adapted to selectively move the lockbar between the locked position and the unlocked position, and translating means mounted between the operator mechanism and the lockbar for translating a generally horizontal input movement of an output link of the operator mechanism in a first direction into a generally vertical output movement of the lockbar in a second direction, with continuous and progressive locking of the sash to the frame being developed as the lockbar is moved from the unlocked position to the locked position, the first strike being engaged with and progressively received and retained along the retaining profile of the first receiver, progressive locking continuing as the second receiver engages and retains the second strike.

The present invention further relates to an apparatus for locking a window having a frame and a sash, adjacent sides of the frame and the sash being movable with respect to each other, with a plurality of receivers mounted on the adjacent side of the sash, a first receiver located near a first end of the sash, and additional receivers located progressively further from the first end toward the other end of the sash, each of the first and additional receivers having a retaining profile, and a lockbar coupled to the adjacent side of the frame and selectively movable between a locked position and an unlocked position, with a plurality of strikes mounted to the lockbar, a first strike located near a first end of the frame, and additional strikes located progressively further from the first end toward the other end of the frame. The apparatus also includes an input device including an operator mechanism and having an output link coupled to the lockbar at the first end of the frame, the input device being adapted to selectively move the lockbar between the locked position and the unlocked position, progressive locking of the sash to the frame resulting as the lockbar is moved from the unlocked position to the locked position, the first strike being engaged with and progressively received and retained along the retaining profile of the first receiver, the particular retaining profiles of the first and additional receivers resulting in the progressive locking of the first strike and first receiver continuing as the additional strikes are engaged and progressively received and retained along the particular retaining profiles in their order from the first strike, such that the progressive locking of the strikes and receivers continues toward the other end of the frame and sash.

BRIEF DESCRIPTION OF THE DRAWINGS

FIG. 6 is an exploded perspective view of two sections of a transmitting device according to an alternative embodiment;

FIG. 7 is a side elevation view of the transmitting device shown in FIG. 6;

FIG. 8 is a cross sectional view taken along the lines 8—8 in FIG. 7;

FIG. 9 is a cross sectional view taken along the line 9—9 in FIG. 7;

FIG. 10 is a side elevation view of the transmitting device of FIG. 6 installed in the frame with coupling made to the locking mechanism and the operator mechanism;

FIG. 11 is a cross sectional view taken along the line 11—11 in FIG. 10;

FIG. 12 is a cross sectional view taken along line 12—12 in FIG. 10;

FIG. 13 is a cross sectional view taken along line 13—13 in FIG. 10;

FIG. 14 is a cross sectional view taken along line 14—14 in FIG. 10;

FIG. 23A is a perspective view of an operator mechanism according to an alternative embodiment (with the frame shown in phantom lines);

DETAILED DESCRIPTION OF THE PREFERRED EMBODIMENTS

Figure 1:
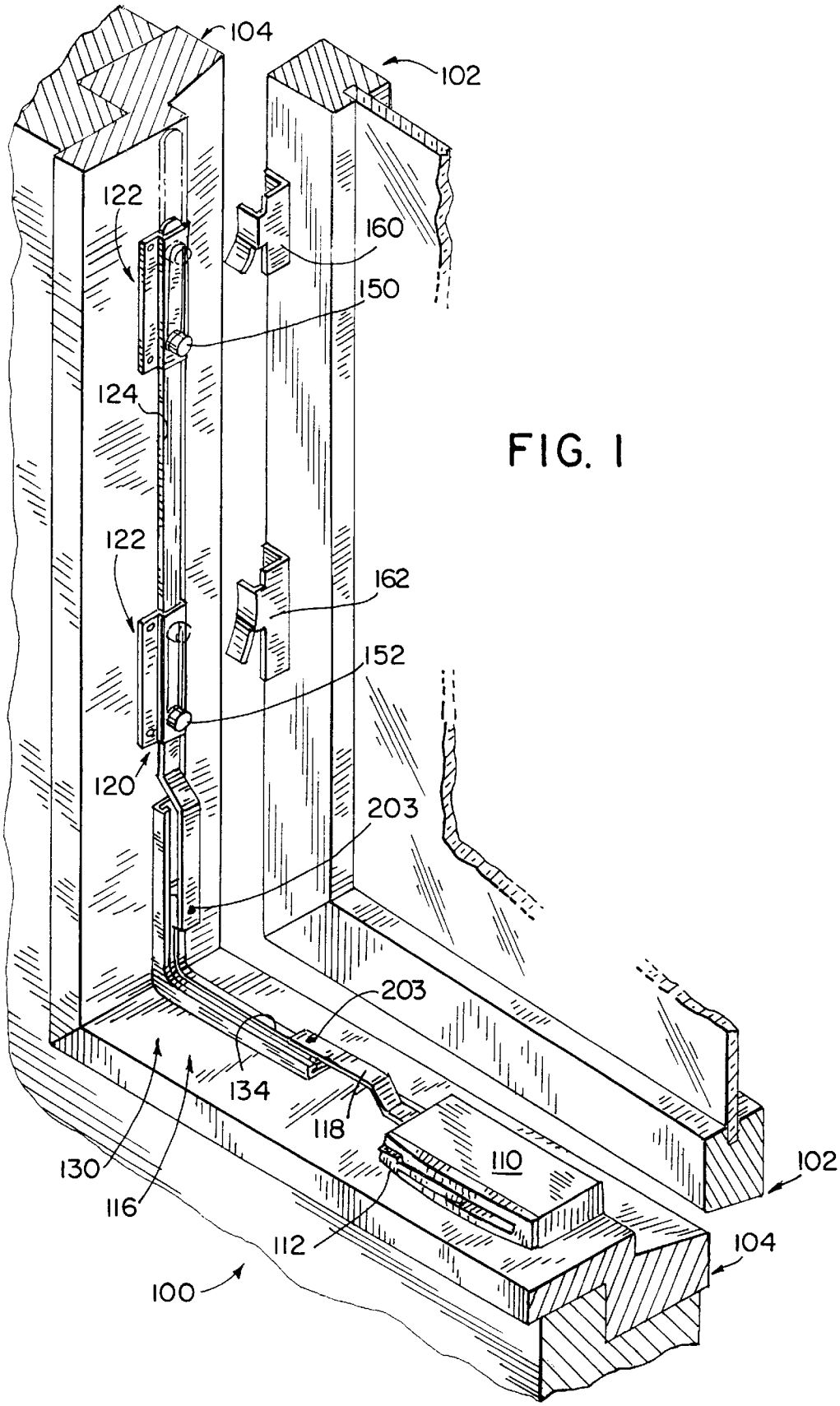
FIG. 1 is a perspective cutaway view of a casement window with a sash and a frame) showing exposed an exemplary embodiment of a multi-point locking system with an operator mechanism and a locking mechanism incorporating a transmitting device.

Referring to FIGS. 1 through 3C, of a multi-point locking system for a casement window according to a preferred embodiment of the present invention is shown. Casement window 100 is of a conventional construction and includes a generally orthogonal window sash 102 (with glass sheet) disposed to fit within a generally orthogonal window frame 104. Sash 102 is mounted to frame 104 according to a conventional arrangement as to enable selective movement (typically pivotal or both pivotal and translational) between a fully opened position and a closed position. Sash 102 and frame 104 are provided with a locking system 120 by which sash 102 can selectively be secured to frame 104. Locking system 120 includes a locking mechanism 122 (mounted at the vertical edge of frame 104 and sash 102) and an operator mechanism 110 shown partially contained in a housing (mounted at the bottom edge of frame 104) with an exposed handle 112. Locking mechanism 122 (oriented in a vertical direction) and operator mechanism 110 (oriented in a horizontal direction) are coupled by a force transmitting device 130 (mounted into the corner of frame 104).

Figure 2:
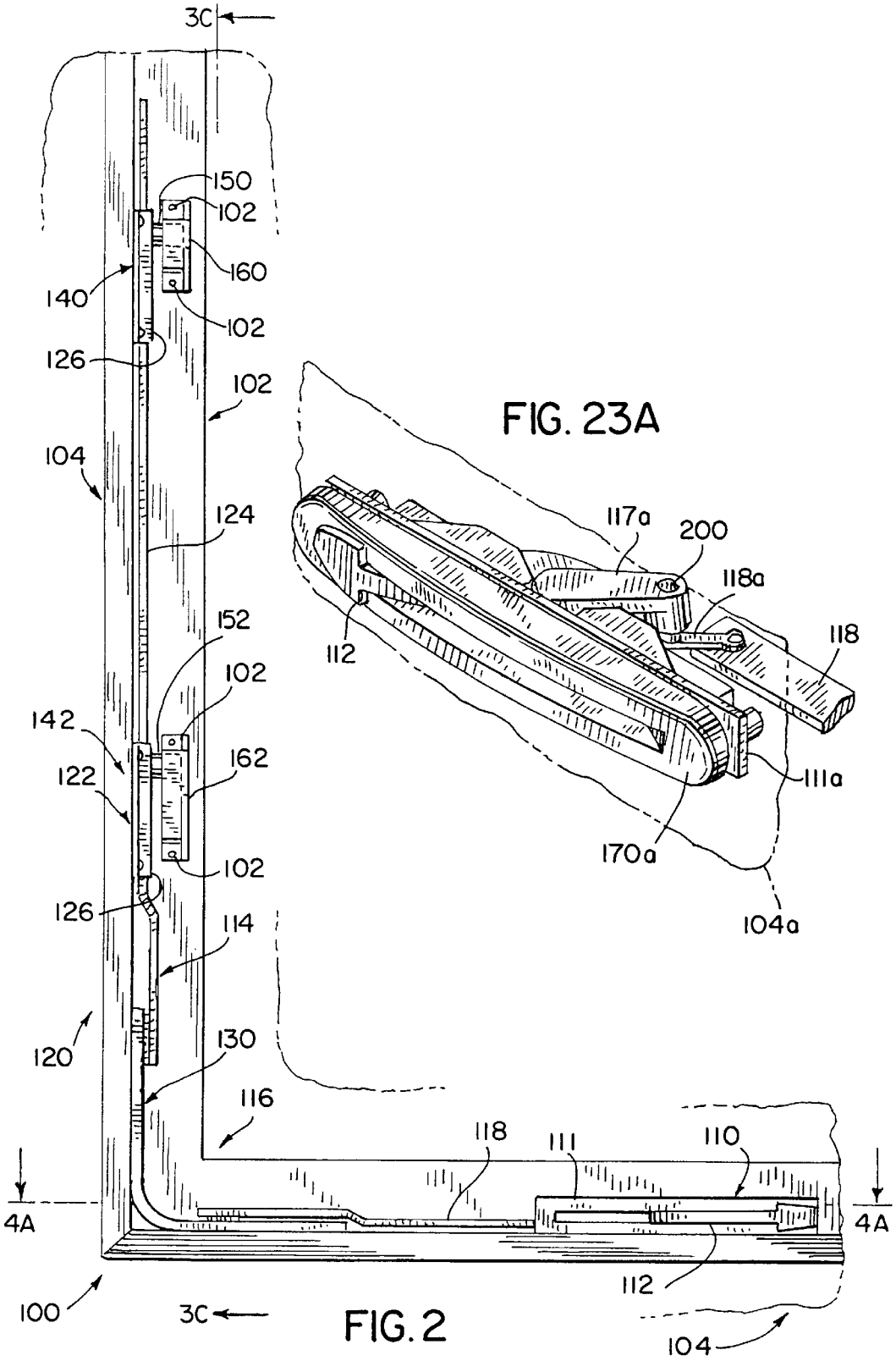
FIG. 2 is a front view of the locking system.

Referring to FIG. 2, locking system 120 is shown from the inside of a space defined by casement window 100. Operator mechanism 110 (in a housing 111) is evident at the bottom of frame 104. Also evident is transmitting device 130 which, along with operator mechanism 110, defines an input device 114 configured to actuate locking mechanism 122. (According to alternative embodiments of the present invention the input device may not include an element such as transmitting device 130; the operator mechanism may be mounted to the vertical edge of frame 104.) Locking mechanism 122 includes lockbar 124 which extends vertically through and is slidably retained within two vertically oriented guides shown as tracks 126 mounted to frame 104 (serving as a lockbar retainer as shown in FIG. 1).

According to the exemplary embodiment, locking mechanism 122 is shown to includes two locking points 140 and 142 (e.g. upper and lower points). Each locking point includes a strike 150 or 152 mounted (through an elongated slot 127 in track 126 as shown clearly in FIG. 3A) to lockbar 124 and a mating receiver 160 or 162 affixed to an exposed edge of sash 102 (by two screws 201 or like fasteners). In FIG. 2, both upper and lower locking points 140 and 142 are shown in a fully engaged or locked position, wherein lockbar 124 has been fully extended away from input device 116 to an upward position; sash 102 is thereby secured to frame 104 (and any associated weather-stripping or the like about each is maintained in an at least partially compressed state) as to close and lock the window. Strikes 150 and 152 have travelled to the upper ends of elongated slot 127 in each respective track 126. When lockbar 124 is retracted toward input device and to a downward position, both upper and lower locking points 140 and 142 are disengaged and sash 102 is released from frame 104 as to permit pivotal movement and opening of the window. Strikes 150 and 152 have travelled to the lower ends of elongated slot 127 in each respective track 126.

Each of strikes 150 and 152 includes a cylindrical tube-shaped section 151 having an axial bore. Cylindrical post section 151 of each of strikes 150 and 152 is mounted to lockbar 124 by a rivet which extends through the bore and serves as a rigidifying post. (According to a particularly preferred embodiment, cylindrical section 151 is made of a plastic material and is free to rotate about metal rivet.) According to an exemplary embodiment, shown in FIGS. 1 through 3C, lockbar 124 is provided with a pair of strikes 150 and 152. According to alternative embodiments, such as for larger windows, more locking points, e.g. strikes and mating receivers of a similar configuration, could be employed. Strikes 150 and 152 are mounted on (e.g. affixed to) lockbar 124 at a prescribed center spacing (i.e. distance) so as to suitably engage a pair of receivers 160 and 162 secured to the perimeter of sash 102 as locking mechanism 122 is actuated.

Figure 3A:
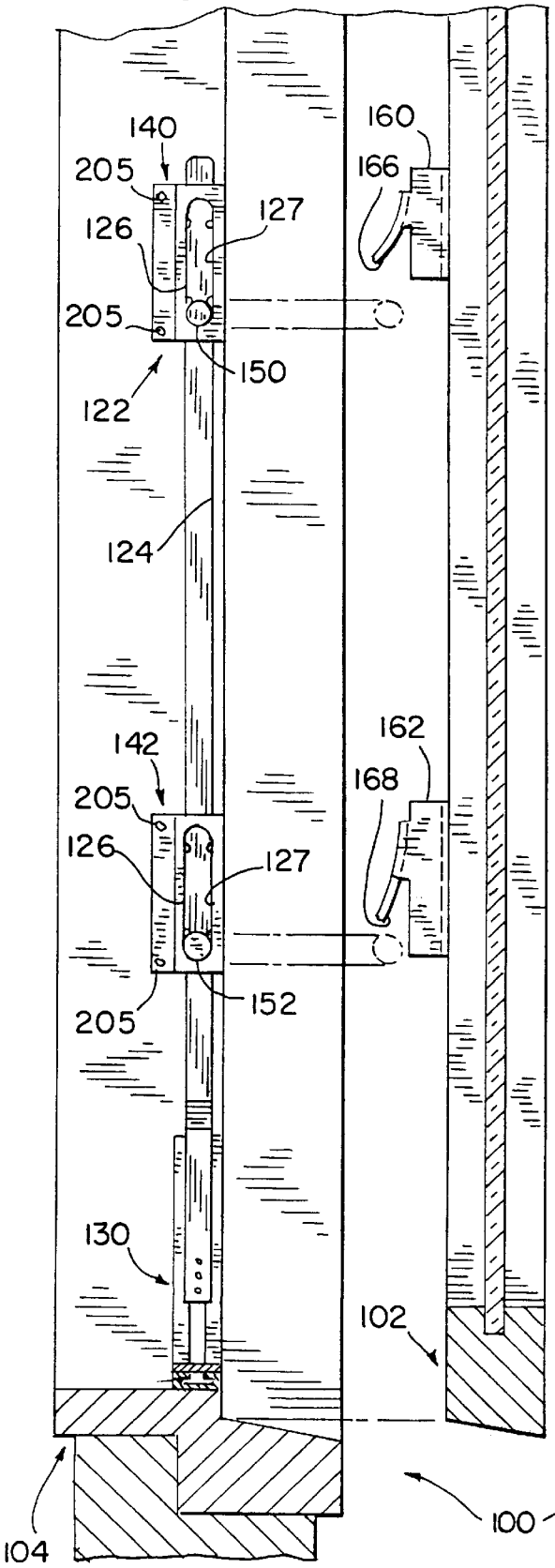
FIGS. 3A through 3C are side views of the locking mechanism of the locking system in various stages of engagement.
Figure 3B:
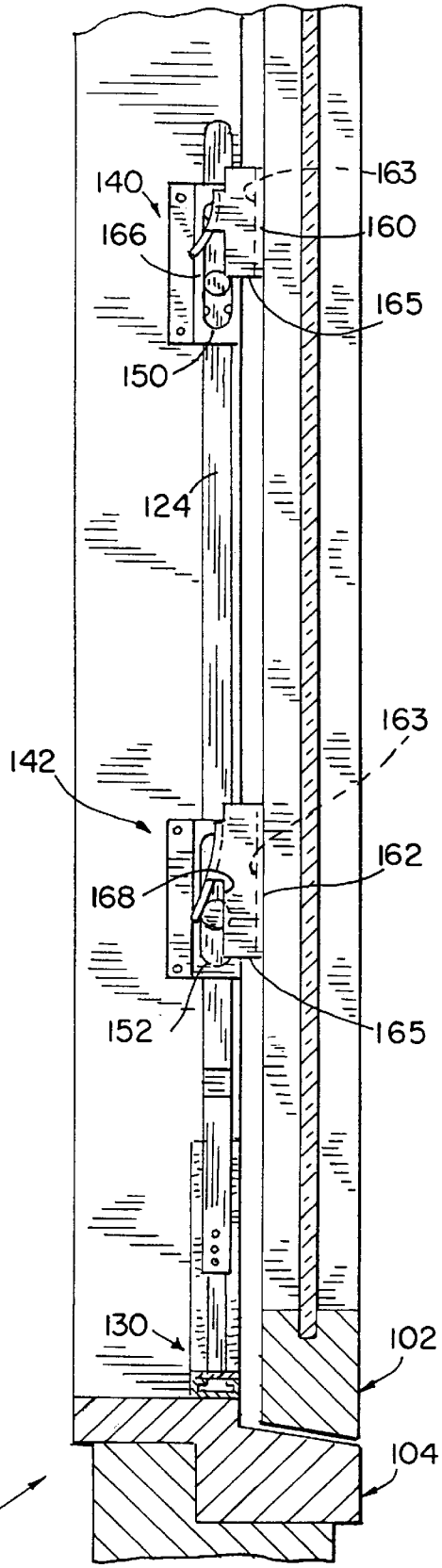
Figures 3C, 5:
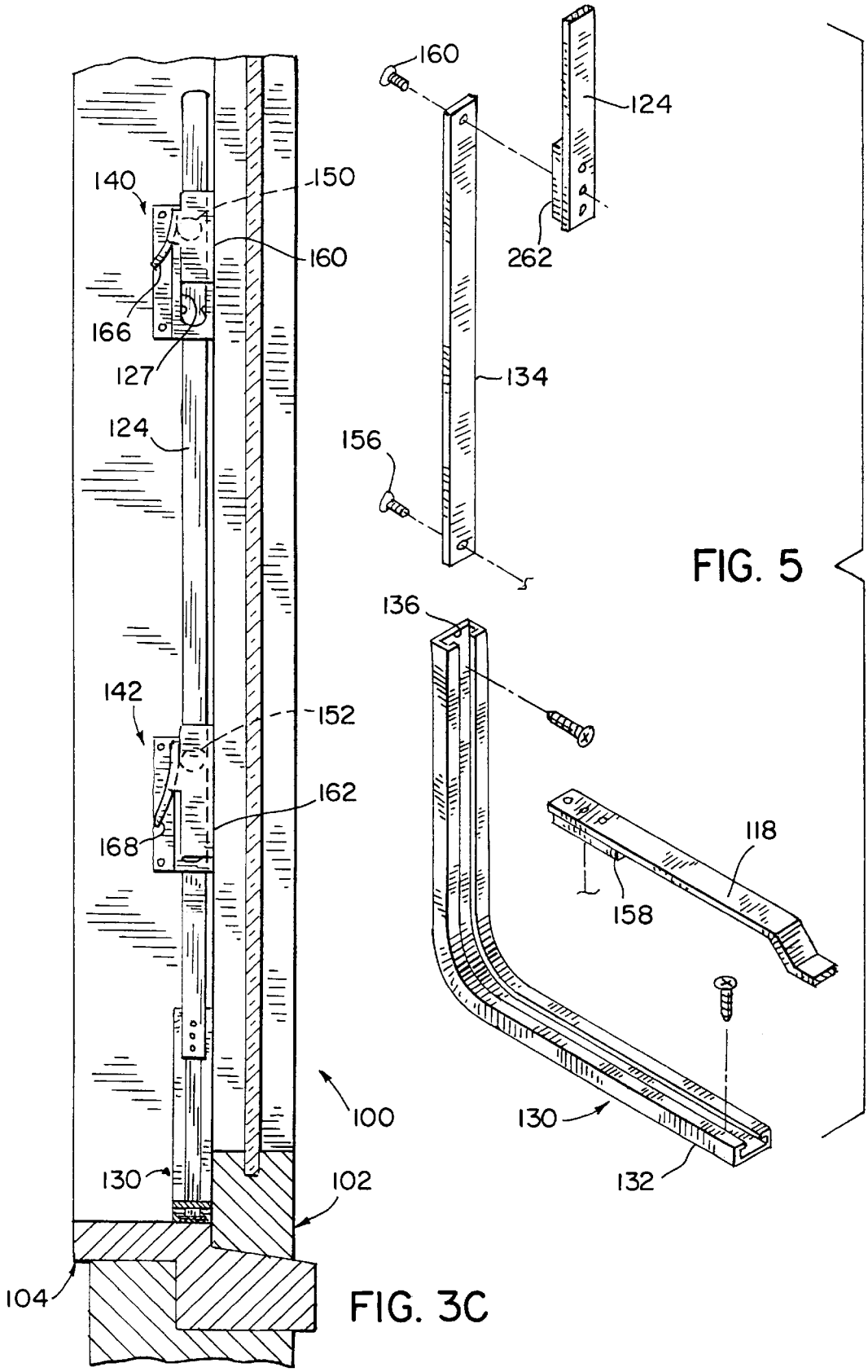
FIG. 5 is an exploded perspective view of the transmitting device according to an exemplary embodiment.

Each of receivers 160 and 162 includes a base section 163 by which mounting is effected and a retaining section 165 extending therefrom to provide an arcuate retaining profile 166 or 168 along which each of strikes 150 and 152 (i.e. at cylindrical section 151) will travel during engagement and disengagement. (According to a particularly preferred embodiment, receivers 160 and 162 are made of a metal or durable plastic material.) As shown in FIGS. 3A through 3C, lower receiver 162 is provided with a retaining portion 168 having an arcuate generally of a first curved radius; upper receiver 160 is provided with a retaining portion 166 having an arcuate profile of a curved radius. Retaining portion 166 of upper receiver 160 is shorter in length and of a smaller radius than retaining portion 168 of lower receiver 162.

Lockbar 124 is coupled to an output link 118 of input device 116 (typically by a fastener like screw 203) and is thereby linearly actuated between a fully-locked and a fully-unlocked position by appropriate manipulation of operator mechanism 110. Operator mechanism 110 is manipulable through handle 112 (e.g. a lever) by which a rotary input movement is imparted to an internal linkage and translated into a suitable linear output movement.

Lockbar 124 is slidably retained within tracks 126. Each track 126 is of a rectangular shape (and cross-section) and is provided with elongated slot 127 within which strike 150 or 152 (extending therethrough) will travel as lockbar 124 is actuated. Each track 126 is of a rectangular cross-section slightly larger in its inner perimeter than a rectangular cross-section of lockbar 124 which has a slightly smaller outer perimeter, so as to allow relatively free slidable movement of the lockbar 124 with respect to and within track 126. (According to a preferred embodiment, the lockbar is made of a suitably strong and rigid material such as metal and each track is made of a durable metal or plastic.) Each track is mounted to frame 104 by screws 205.

FIGS. 3A through 3C show locking system 120 with locking points 140 and 142 in three stages of engagement, namely fully engaged (i.e. "locked"), partially engaged, and completely disengaged (i.e. "unlocked"). I n FIG. 3C, sash 102 is "locked" (i.e. secured) to frame 104 and the engagement of upper and lower locking points 140 and 142 is evident, with upper strike 150 retained along retaining profile 166 of upper receiver 160 and lower receiver 162. In FIG. 3B, lower locking point 142 is engaged but upper lower locking point 150 is disengaged (as would be the case either when locking or unlocking of the window is incipient) and sash 102 is only partially secured to frame 104. As is evident in FIG. 3B, once lower strike 152 has been retained at this point along retaining profile 168 of lower receiver 162, upper strike 150 has been pulled toward upper receiver 160 and as locking action continues, lower strike 152 is guided along arcuate retaining profile 168 of lower receiver 162. In FIG. 3C, both upper and lower locking points 140 and 142 are completely disengaged (and sash 102 is shown pivoted away from frame 104). As is seen in comparison of FIGS. 3A through 3C, the relative distances between the mounting positions of strikes 150 and 152 (on lockbar 124) and the mounting positions of corresponding receivers 160 and 162, as well as the shape of retaining profiles 166 and 168, will tend to facilitate a smooth and progressive locking effect.

As is evident, with sash 102 drawn to the closed position with respect to frame 104 (as shown in FIG. 3B), progressive locking action can be effected. At handle 112 an input force is applied to provide an input movement which is transmitted from operator mechanism 110 to locking mechanism 120. Handle 112 is rotated in the counterclockwise direction (from the "unlocked" position to the "locked" position), driving output link 118 of input device 116 to urge lockbar 124 and lower strike 152 upward to the point where it first engages an exposed surface presented by retaining profile 168 of lower receiver 162 (near its free lower end). As handle 112 is rotated further in the counter-clockwise direction, lower strike 152 travels along retaining profile 168 of lower receiver 162, pulling and drawing sash 102 into a more tightly closed position with respect to frame 104; pulling will continue to a point where upper strike 150 can readily be captured by retaining profile 166 of upper receiver 160, notwithstanding any misalignment that may exist in or between sash 102, frame 104 or any of the various elements of locking system 120. As handle 112 is rotated still further, and lower strike 152 travels further along arcuate retaining portion 168, upper strike 150 will begin to engage an exposed surface presented by retaining profile 166 of upper receiver 160 (near its free lower end). Due to the longer length of retaining profile 168 (of lower receiver 162) as compared to retaining profile 166 (of upper receiver 160), the engagement of lower strike 152 with lower receiver 162 progressively pulls sash 102 into a more tightly closed position, which serves to ensure that upper strike 150 will be in a position for capture by retaining profile 166 of upper receiver 160. As handle 112 is rotated still further, upper strike 150 begins to travel along arcuate retaining profile 166 of upper receiver 160 while lower strike 152 continues to travel along retaining profile 168 of lower receiver 162. By the time handle 112 has been moved to a fully counter-clockwise position, the lower strike 152 and upper strike 150 will each be fully received under retaining profiles 168 and 166 of corresponding lower receiver 152 and upper receiver 150.

As is evident, with the locking mechanism operating in this manner, an input force applied to handle 112 to lock the casement window is smoothly and progressively employed to bring sash 102 into the locked position by first engaging lower strike 152 along the gentler slope of retaining portion 168 of lower receiver 162, and only after sash 102 has begun to move to its fully-closed position is upper strike 150 taken into engagement with retaining portion 166 of upper receiver 150. Unlocking releases locking points 140 and 142 in the reverse progression. As is also readily apparent in view of the disclosure of the present invention, in alternative embodiments, the shapes of either the strikes or the receivers can be adjusted in various combinations of shapes, sizes and mounting center distances to obtain a desired progressive locking effect. (In alternative embodiments, the respective positions of the strikes and receivers with respect to the lockbar and window frame may be reversed.)

Figure 4A:
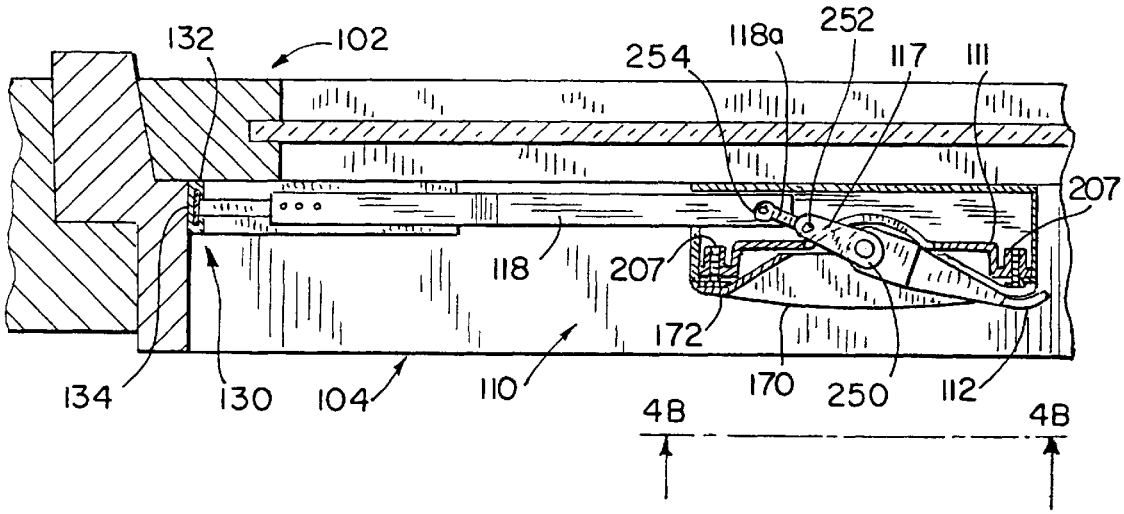
FIG. 4A is a top plan view of the operator mechanism.
Figure 4B:
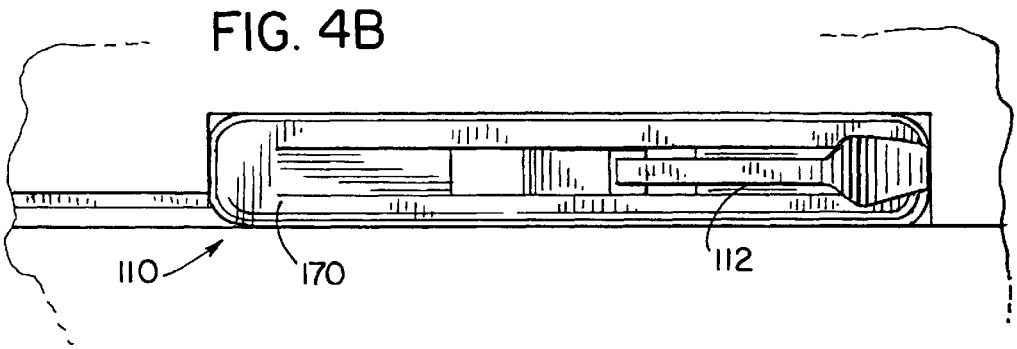
FIGS. 4B and 4C are front views of the operator mechanism.
Figure 4C:
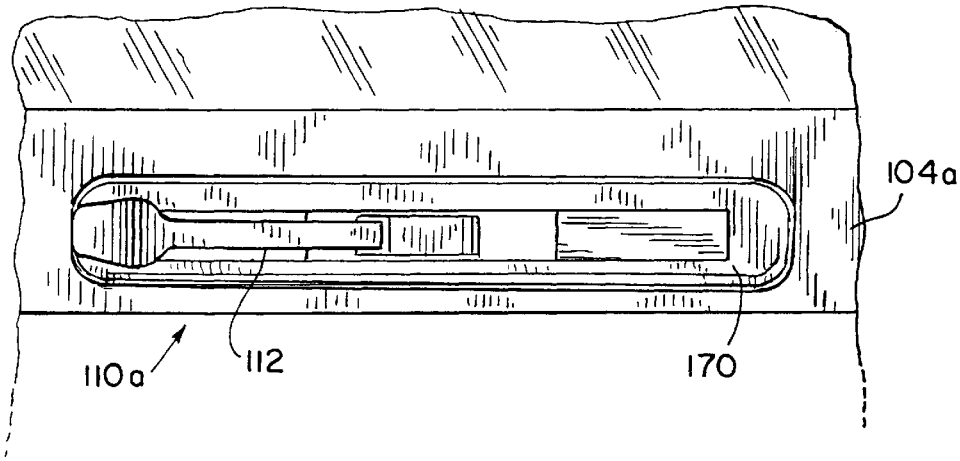

Referring to FIGS. 4A through 4C, operator mechanism 110 is shown in greater detail. The internal arrangement of operator mechanism 110, no longer shown as contained within a housing 111, is shown in FIG. 4A. Handle 112 extends outwardly through a removable bezel 170 (e.g. a "snap-fit" cover plate) affixed to a front mounting plate 172 affixed to housing 111 by fasteners (shown as screws 207). Handle 112 is pivotally mounted (as shown at point 250) to housing 111 (or a mounting plate) which is secured to frame 104. Handle 112 is pivotally attached (as shown at point 252) to a coupler link 117 which in turn is pivotally attached (as shown at pivot point 254) to an output link 118 that is coupled (by one or more screws) transmitting device 130 (shown to include a tape 134 slidably retained within a guide 132). According to a particularly preferred embodiment, the pivot points are rivets or posts (with spacers as needed).

With handle 112 in the "locked" position (shown by the full lines in FIG. 1), coupler link 117 is moved to the left, in which position lockbar 124 (through output link 118 and transmitting device 130) is advanced to a "locked" position, where the locking points 140 and 142 are engaged. Conversely, when handle 112 is rotated to the right, lockbar 124 is returned to the "unlocked" position (shown by the dashed lines in FIG. 1), where the elements of locking points 140 and 142 are no longer engaged. (According to the exemplary embodiment shown in FIG. 1, a tape 134 of transmitting device 130 serves as output link 118 of input device 116, in alternative embodiments, other intermediate links may be included to provide the progressive locking function; in further alternative embodiments without the transmitting device, the coupler link may serve directly as the output link of the input device.)

As shown in FIGS. 1 through 4, locking system 120 may be provided with transmitting device 130 such that horizontally-disposed operator mechanism 110 (located at the base or bottom of frame 104) can be used to actuate vertically-disposed locking mechanism 122 (located on the side of frame 104 and sash 102). Transmitting device 130 of a type that can be used to effectuate the "around the corner" coupling of operator mechanism 110 to locking mechanism 122, according to a conventional exemplary embodiment, is shown in FIG. 5. Transmitting device 130 includes a one-piece guide 132 (adapted for mounting to frame 104) and a longitudinally stiff and laterally flexible tape 134 disposed in a slot 136 in guide 132 to provide a suitably rigid coupling between operating mechanism 110 and locking mechanism 122.

As is evident from FIGS. 1 through 5, an input force applied to operator mechanism 110 by movement of handle 112 is transmitted through output link 118 and to tape 134. As shown in FIG. 5, coupling of output link 118 to tape 134 includes a rivet or screws (shown by reference numerals 156) which passes through corresponding apertures in output link 118, a retaining spacer 158 and tape 134. The manner in which tape 134 is connected to locking mechanism 110 is similar with a rivet or screw (shown by reference numeral 160) which passes through lockbar 124, a retaining spacer 262 and tape 134.

Referring to FIGS. 6 through 14, a guide 232 according to a particularly preferred embodiment is shown. Guide 232 is formed of two substantially identical sections 231 and 233. The cross-section of each of sections 231 and 233 is generally J-shaped, having a longer leg 234, a base 235 and a shorter leg 236. Sections 231 and 233 are formed with a curved portion and two legs extending from curved portion at right angles to each other. Each of sections 231 and 233 is provided with a pair of mounting tabs extending from longer legs 234. Each of mounting tabs 237*a* and 237*b* is formed with a thickness which is approximately one-half of that of longer leg 234. Mounting tab 237*a* is formed closer to shorter leg 236, while mounting tab 237*b* is formed with one side flush with the outer surface of longer leg 234. Curved portion of each of sections 231 and 233 is provided with a hole 238 and a projecting pin 239. When assembled to form guide 232, sections 231 and 233 are mated with each other, as tabs 237*a* and 237*b* overlay each other. The overlayment of tabs 237*a* and 237*b* is best shown in FIG. 8; the mating of pins 239 and holes 238 are best shown in FIG. 9. Pins 239 are received in holes 238 in a "snap fit" arrangement to secure sections 231 and 233 to each other. Each of tabs 237*a* and 237*b* is provided with an aperture 240 for receiving a fastener for securing guide 232 to frame 104. Tabs 237*a* and 237*b* are provided with counter-sinks 241 such that the head of a fastener suitably passing through aperture 240 will not protrude or project into a slot 236 (which is adapted to receive a slidable tape) formed between two sections 231 and 232 as shown in FIG. 8. FIG. 7 shows guide 232 assembled in a corner of frame 104 (which is shown broken away). A tape 134 is shown projecting from the upper end of guide 232 (and is further shown in a broken away bottom portion of guide 232). (According to a particularly preferred embodiment, guide 232 is made of a durable plastic material such as "DELRIN".)

Referring to FIGS. 10 though 14, it is shown that guide 232 is secured to a rigidifying metal strip 242 by a fastener such as a rivet 209 shown in FIG. 13, which secures sections 231 and 233 of guide 232 to each other and to strip 242. As shown in FIG. 11, coupler link 117 is retained to strip 242 by a rivet-like fastening member 211 which passes through a hole in strip 242, a slot in link 117, and a hole in a U-shaped clamp 243; the legs of clamp 243 are received in slots formed in strip 242. Lockbar 124 is coupled to tape 134 by a rivet 213 which extends through a hole in spacer 215, an elongated slot in output link 118, a hole in a spacer 217, and a hole in a U-shaped clamp 244; the legs of clamp 244 are received in slots in strip 242.

Figure 15A:
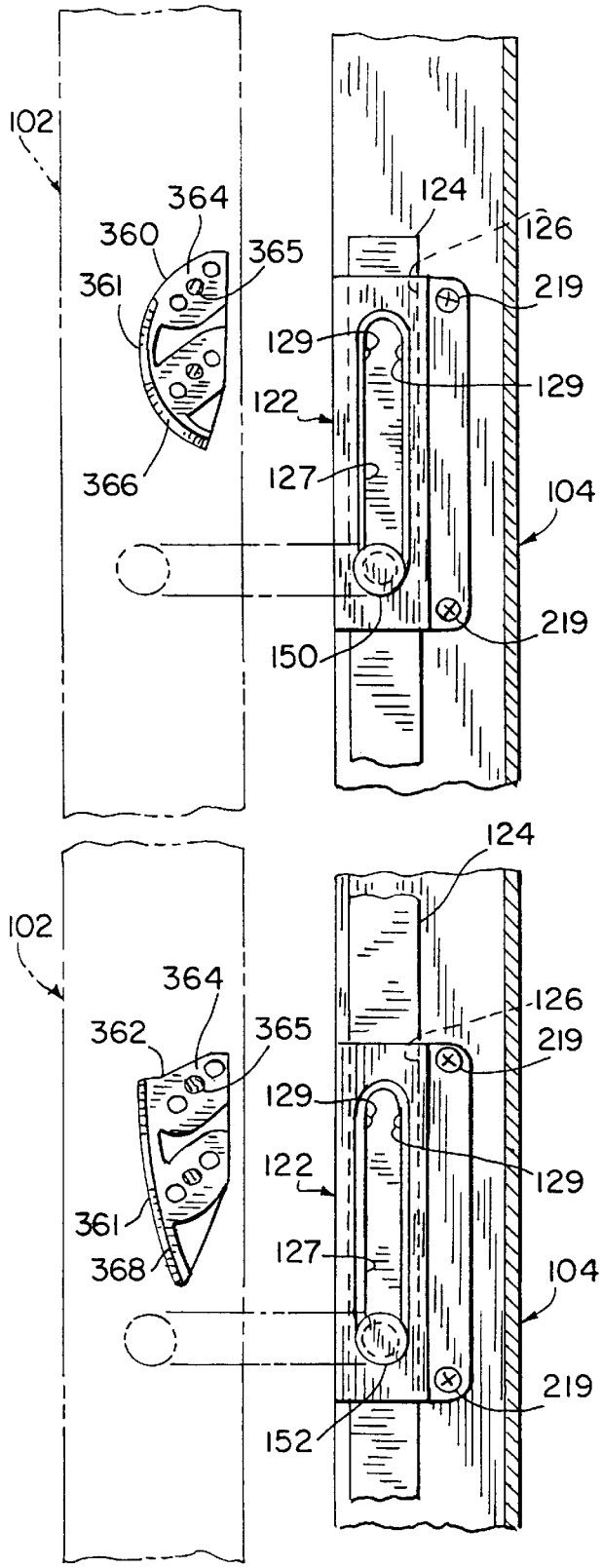
FIGS. 15A through 15C are front elevation views of a locking system (with portions broken away) according to an alternative embodiment.
Figure 15B:
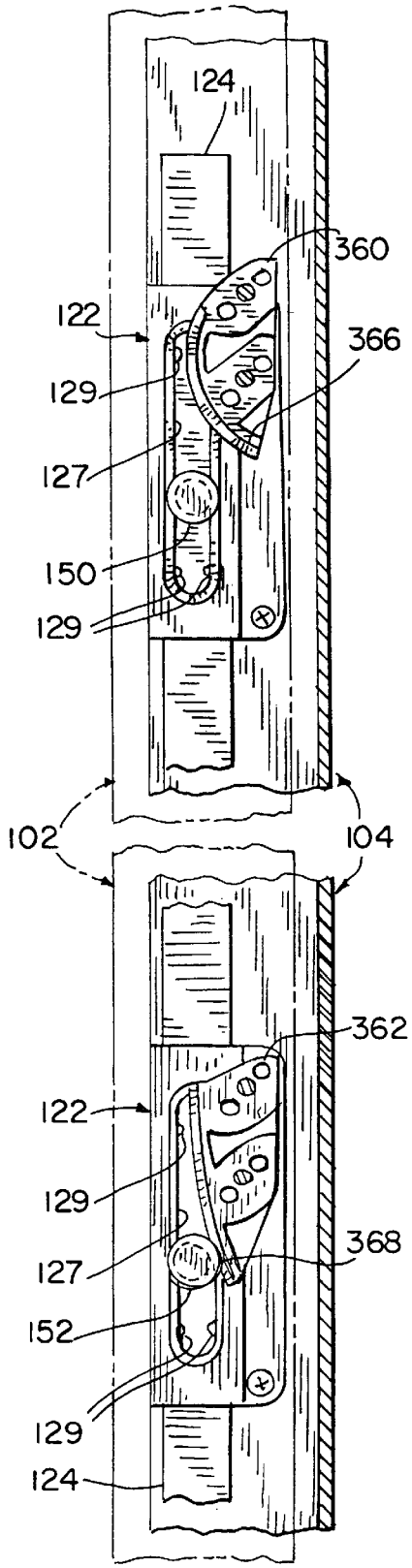
Figure 15C:
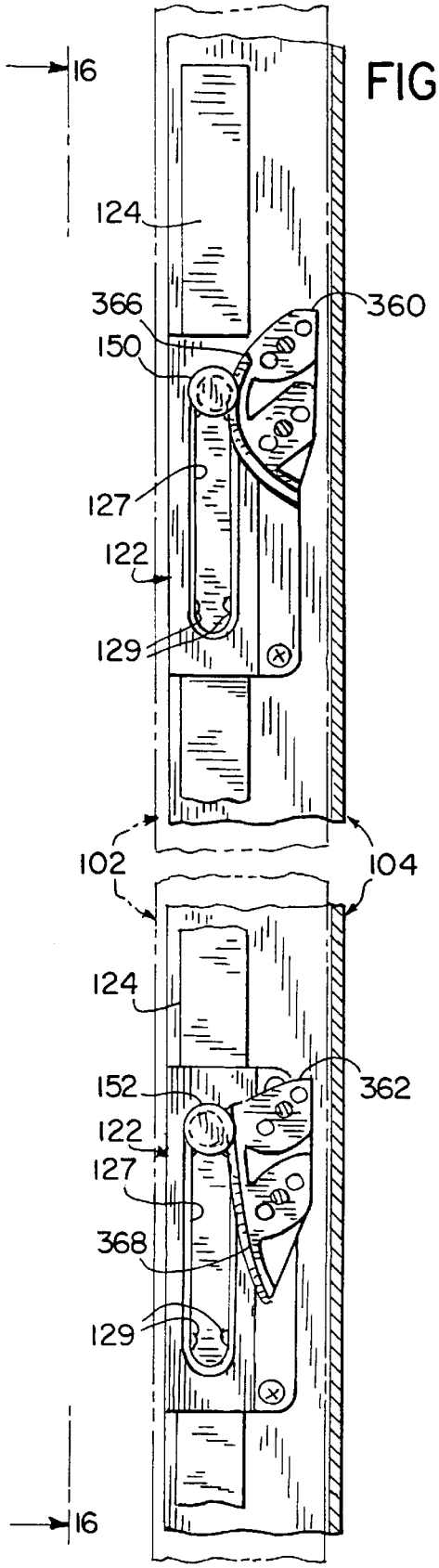

Referring though FIGS. 15A and 16, and FIGS. 21 through 22 (showing a reversed mounting orientation), an alternative embodiment of this invention is shown (in which similar components of the multi-point lock arrangement are identified with the same reference numerals). Because this alternative embodiment is primarily directed to a variation in strike and receiver construction, the input device (e.g. operator mechanism) is not shown. In this embodiment, receivers 360 and 362 are of a more compact form, having mounting section 364 provided with six holes 365 oriented in a staggered pattern so as to provide for a plurality of variations in mounting positions (although in alternative embodiments mounting may be effected with fewer or more holes or by other known mounting arrangements, which may depend on the configuration of the receiver or other elements). Lower receiver 362 has an arcuate retaining profile 368. Upper receiver 360 has an arcuate retaining profile 366 of a smaller radius than arcuate retaining profile 368 of lower receiver 362. As shown in comparison of FIGS. 15A through 15C (and also FIGS. 21 and 22, in a reversed orientation for a opposite-side window mounting), it can be readily observed that lower strike 152 will engage arcuate retaining profile 368 of lower receiver 362 prior to any engagement by upper strike 150 with arcuate retaining profile 366 of upper receiver 360. After lower strike 152 first travels along retaining profile 368, upper strike 150 will then engage and travel along retaining profile 366, to provide a continuous and progressive locking of the window sash to the window frame. (Mating full-strikes 150 and 152 as shown in this exemplary embodiment are provided with a rim 351 that may ride over the outer surface of a lip 361 of each retaining profile 366 and 368.)

Figure 16:
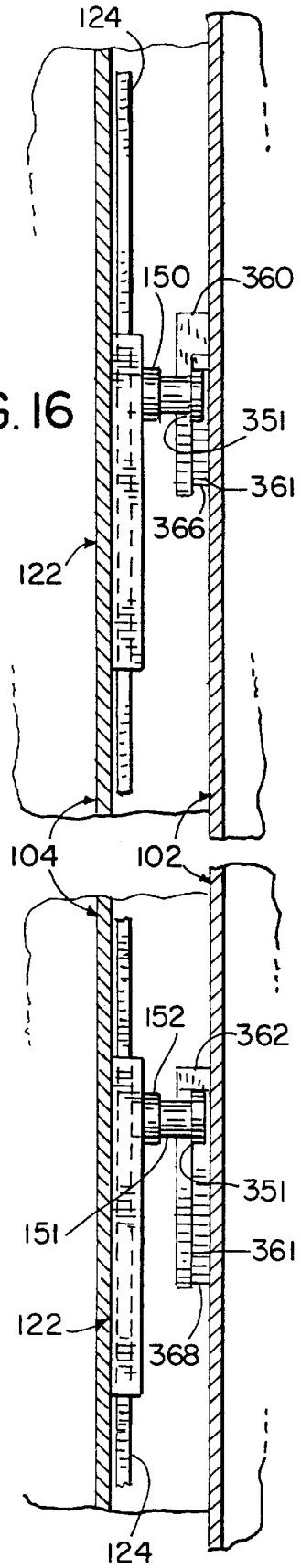
FIG. 16 is a side view of the multi-point casement window looking system shown in FIG. 15C.

According to the alternative embodiment shown in FIGS. 15 through 16, each track 126 of locking mechanism 110 includes a detent arrangement that is configured to releasably retain locking mechanism 122 in either a locked or unlocked position. (As shown, track 126 is secured to the window frame by suitable fasteners such as screws received in holes 219, and are provided with elongated slot 127 respectively, through which strikes 150 and 152, coupled to lockbar 124 by posts or rivets, extend.) A pair of inwardly extending and opposed projections shown as detents 129 are provided near each end of slot 127. Detents 129, which extend into slot 127, are spaced apart (i.e. across slot 127) as to provide a slight interference and frictional resistance as strikes 150 and 152 (which are of a lesser cross-section dimension than slot 127, but greater cross-section dimension than the distance across detents 129) pass between detents 129. As handle 112 is moved from the locked position to the unlocked position, the resistance presented by detents 129 will tend to provide an indication (e.g. a snap or click) to a person operating handle 112 that the locking points have reached either the fully-engaged or fully-disengaged position. Detents 129 also serve to hold certain elements of locking mechanism 110 (e.g. lockbar 124 and track 126) together (e.g. in the fully closed position) during the shipment and field installation of the locking system.

Figure 17:
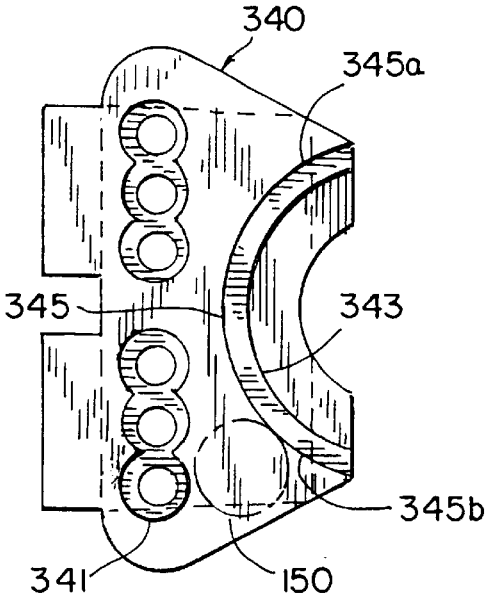
FIGS. 17 through 20 are top plane views of alternative forms of locking elements of a locking system according to alternative embodiments.
Figure 18:
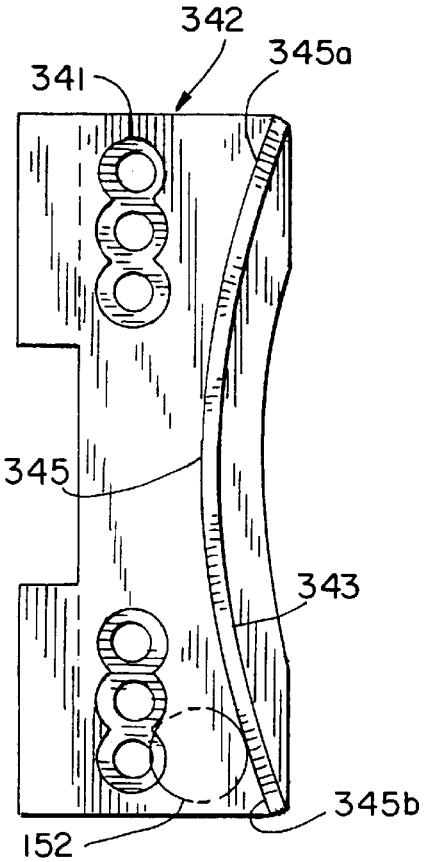

Referring to FIGS. 17 and 18, an alternative embodiment of first and second locking elements (e.g. receivers) configured to provide progressive locking when installed in the locking system is shown. (Strikes 150 and 152 are shown in phantom lines.) First and second locking elements 340 and 342 respectively are of a compact form and have a mounting section 341 and a retaining section 343. Each mounting section 341 is provided with two sets of three holes for mounting on a window sash by a known fastener arrangement (e.g. screws) in a variety of orientations. Each retaining section 343 has a symmetrical retaining profile 345 with upper and lower retaining surfaces 345*a* and 345*b*. Only one of these retaining surfaces will be used to provide the locking action for the window sash. However, because each locking element is provided with two retaining surfaces, it may be mounted with mounting section 341 extending toward either the right or the left side of the sash. As a result, arcuate retaining section 343 of each of first and second locking elements 340 and 342 have a retaining profile 345 with two retaining surfaces 345*a* and 345*b* that will function according to the mounting orientation. The retaining section may be provided with an intermediate recess (not shown) to retain a strike slightly when it has travelled to a substantially central point along the retaining profile.

Figure 19:
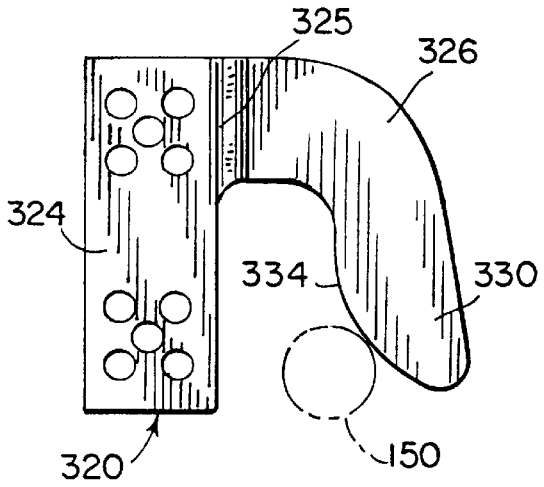
Figure 20:
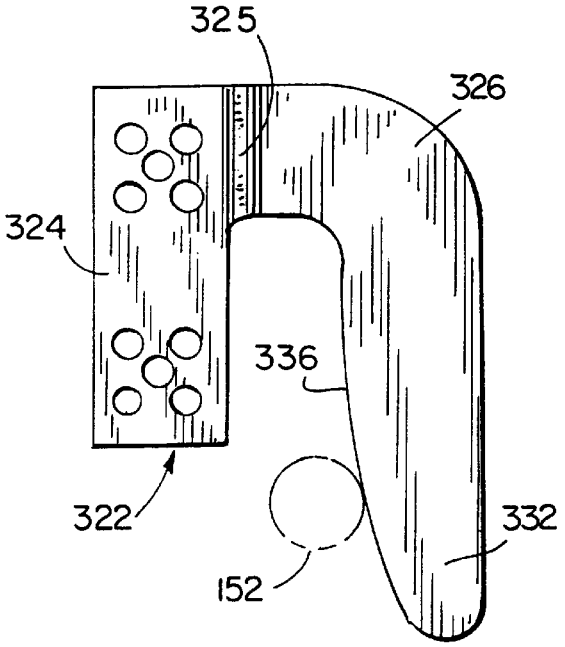
Figure 21:
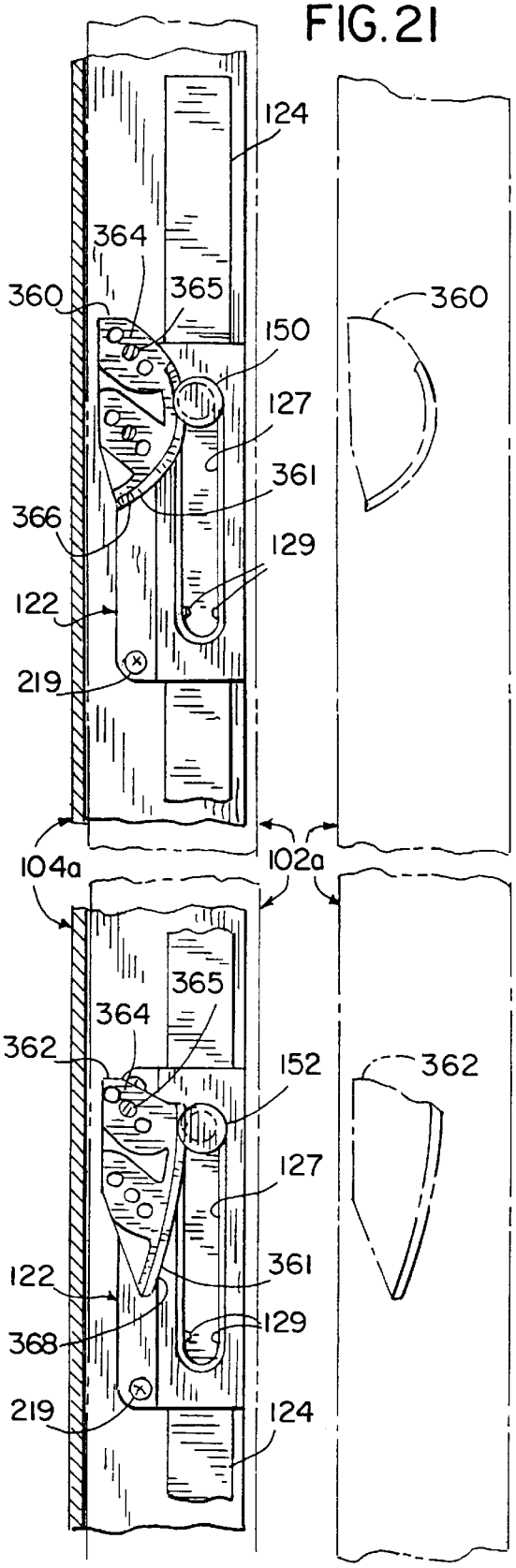
FIGS. 21 and 22 are elevation views of a locking system similar to FIG. 15A and 16 but in a reversed orientation (which portions broken away) according to an alternative embodiment.
Figure 22:
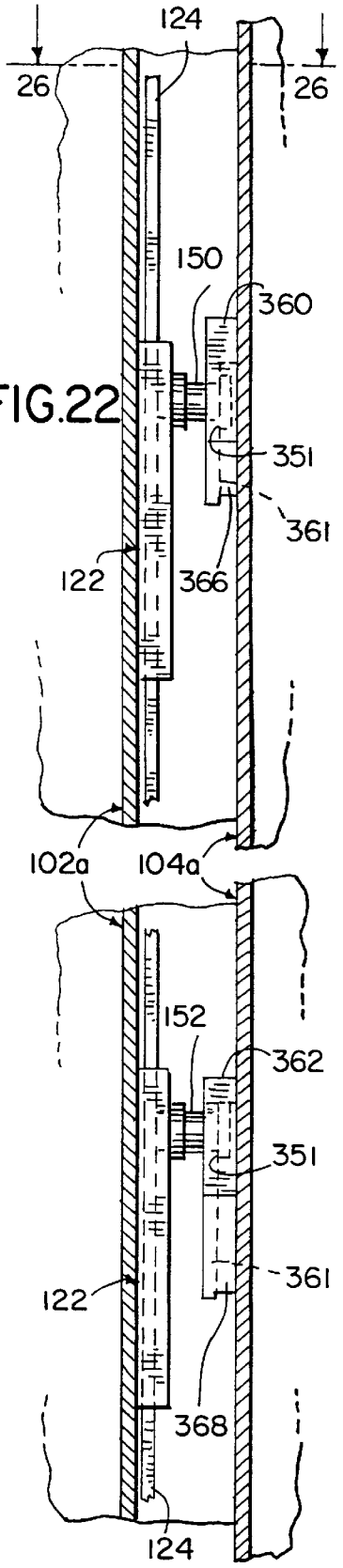

Referring to FIGS. 19 and 20, an alternative embodiment of first and second locking elements (e.g. upper and lower receivers) configured to profile provide progressive locking is shown. (Strikes 150 and 152 are shown in phantom lines.) First and second locking elements 320 and 322, respectively, are formed as brackets having substantially parallel mounting and retaining sections 324 and 326 connected by an offsetting section 325. In order to provide for greater adjustment and mounting flexibility, mounting section 324 is provided with two sets of five holes so as to provide for a plurality of alternative mounting positions on a window sash. Retaining profiles 330 and 332 are provided with arcuate-shaped engaging edges 334 and 336 that are configured to develop a particular progressive locking effect when installed in the progressive locking mechanism.

It has been observed that in a multi-point locking system when multiple strikes are simultaneously engaged upon multiple receivers, misalignment of the receivers and strikes may increase the input force necessary to affect engagement of all receivers and strikes (if successful engagement is even possible). In sequential locking systems where first one strike and its mating receiver is engaged, and then other strikes and other mating receivers are engaged sequentially, the required operating force may fluctuate (i.e. increase and decrease) significantly as each set of strikes and mating receivers are engaged, one after another. The progressive engagement of a multi-point locking system may provide for a general reduction in (or smoothing) of the input force required to effect locking.

Figure 27:
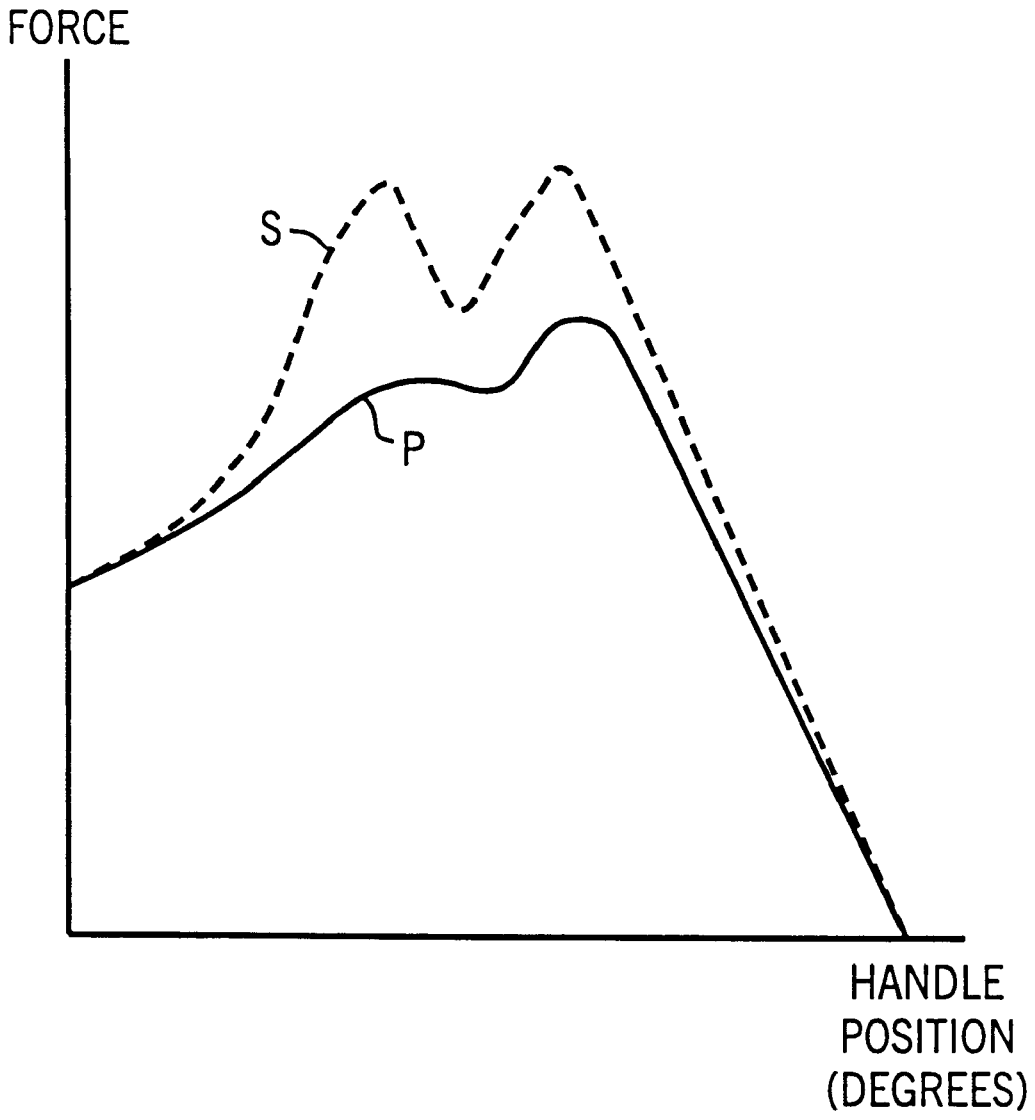
FIG. 27 is a graph representative of the relationship between closing force and input movement required to engage two locking points on a window in accordance with a sequential locking system known in the art and an exemplary embodiment of a progressive locking system.

FIG. 27 is a graphical relationship of the input rotation (e.g. handle position) and approximate locking force required to sequentially engage two locking points in accordance with a prior art arrangement (shown in a representative fashion shown by a dashed line S) and the approximate locking force required to progressively engage two locking points by employing a locking system in accordance with an exemplary embodiment of the present invention (shown in a representative fashion in a solid line P). The closing force is represented by the vertical axis, and the input rotation on the horizontal axis. It will be noted that there are two relatively significant peaks in the closing force of the sequential locking arrangement (see line S). It should be noted that not only can the peak force be reduced somewhat with a progressive locking arrangement, but also that only one significant force peak is encountered (see line P), occurring as the second locking point is engaged. As illustrated, with a progressive locking arrangement, an overall reduction in locking force may be achieved and significant repetitive increases and decreases in the locking force may be reduced. (The unlocking forces would follow along the same basic curve as shown for closing except in the opposite direction.) This progressive locking arrangement provides for a locking system that may be more appropriate for use with an automated control (or a motor drive) or integrated operation system for both opening (or closing) the window and unlocking (or locking) the window.

Figure 23B:
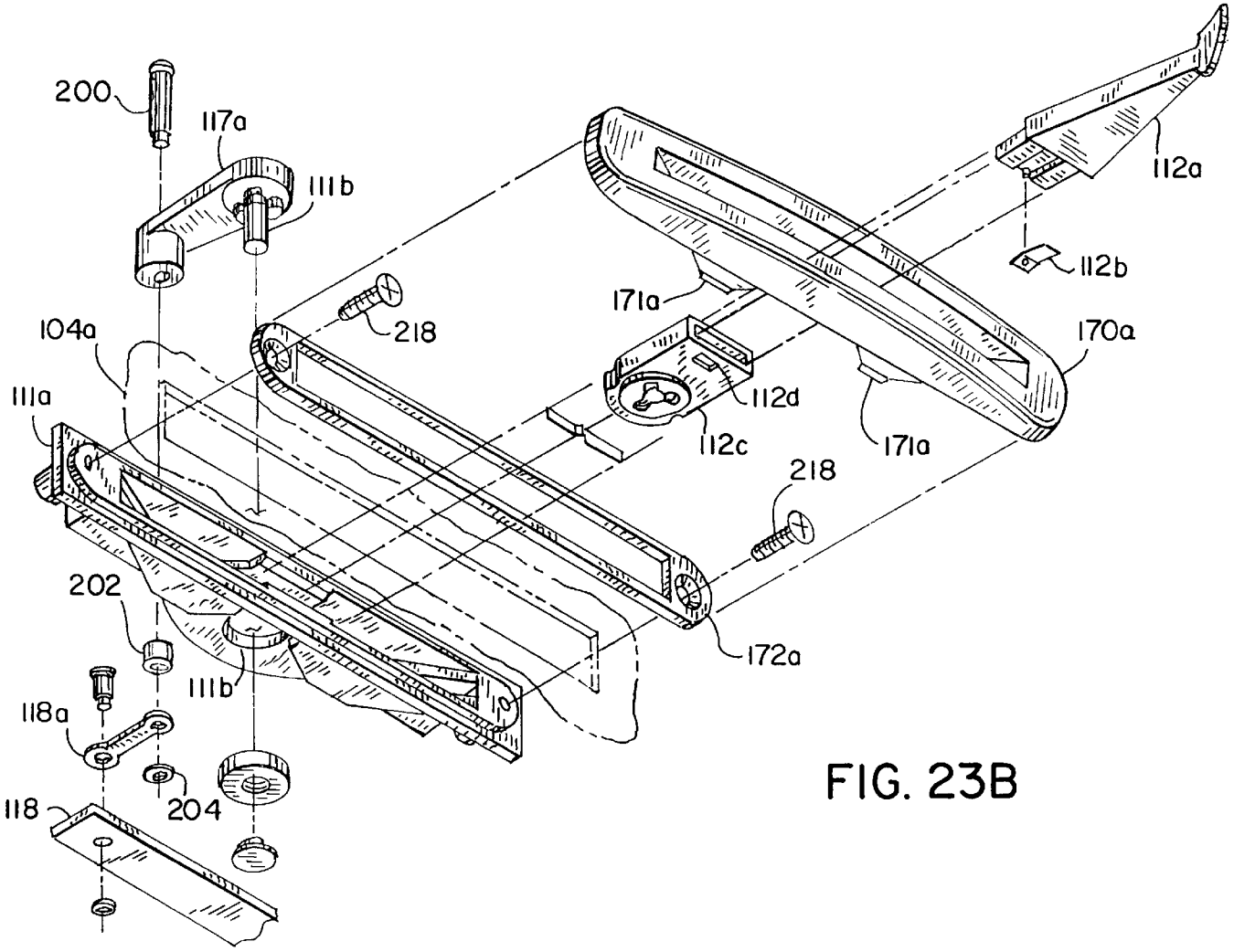
FIG. 23B is an exploded perspective view of the operator mechanism of FIG. 23A.

Referring now to FIGS. 23A through 26, wherein operator mechanism 110a is shown in accordance with an alternative embodiment. (The locking system shown in FIGS. 4A through 4C is similar in most aspects to that shown in the previously described embodiments, except that operator mechanism 110*a*, and particularly the manner in which it is mounted within frame 104*a* (of a different window type, e.g. extruded) has been modified; similarly components in FIGS. 23A through 26 are identified by the same numerals used with respect to previously described embodiments.) Referring to FIG. 23B, a multi-piece handle 112*a* is received through a bezel 170*a* and a faceplate 172*a* into a housing 111*a* mounted at or within frame 104*a*. Referring to FIGS. 23A and 23B, it will be seen that by removing bezel 170*a* (which is configured for a snap fit into housing 111*a* by a set of projections 171*a*), access may be made to fasteners shown as screw 218 which secures faceplate 172*a* of operator mechanism 110*a* to housing 111*a*.

Figure 24:
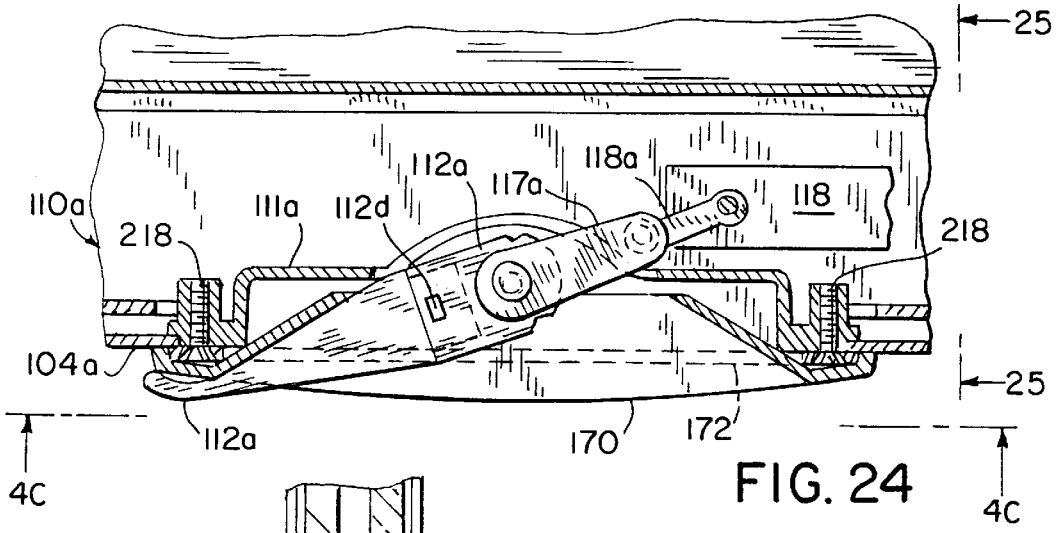
FIG. 24 is a top plan view of the operator mechanism shown in FIG. 23.
Figure 25:
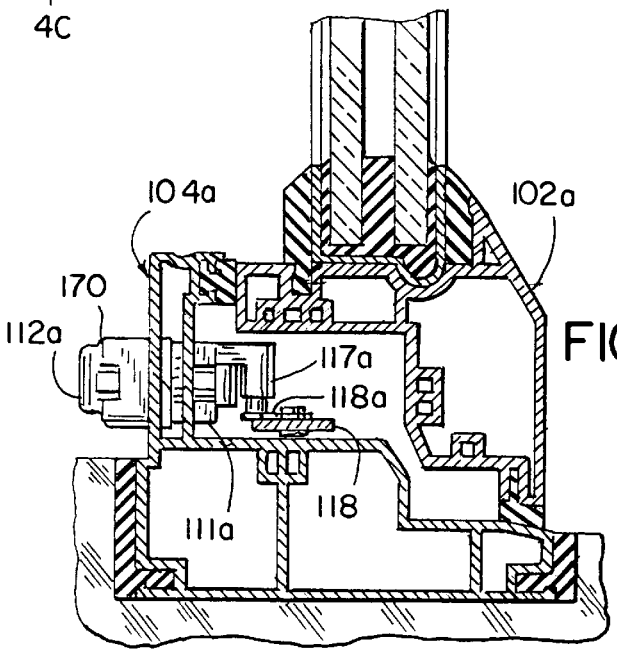
FIG. 25 is a cross sectional view taken along the line 26—26 in FIG. 24.
Figure 26:
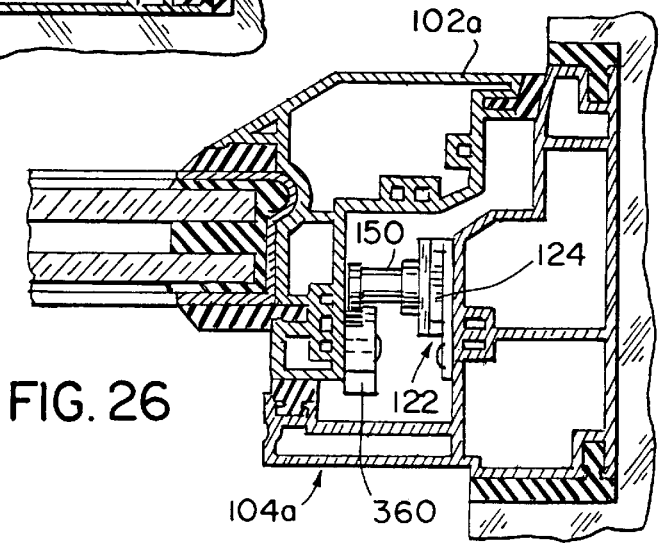
FIG. 26 is a cross sectional view taken along the line 26—26 in FIG. 24.

Handle 112*a* has a removable level section 112*b* which is insertable into a pivot section 112*c* and held by a clip 112*d*. Bezel 170*a* conceals faceplate 172*a* (which is fastened to housing 111*a* by two screws 218) when snapped into place, so that only bezel 170*a* and level section 112*b* of handle 112*a* are ordinarily visible through frame 104*a*. Pivot section 112*c* of handle 112*a* is pivotally coupled through a mounting hole 111*b* in housing to a coupler link 117*a* by a coupler element 117*b*; coupler link 117*a* is then pivotally coupled to an output link 118*a*. (Each pivotal coupling is shown to employ a pivot pin 200 with a mating retaining element 202 and a washer or like spacer 204.) As shown in FIGS. 24 to 26, this arrangement of operator mechanism 110*a* is substantially contained in a mounting region of frame 104.

This mounting arrangement quite advantageously provides for free access to operator mechanism 110*a* from the interior space or area defined by the casement window installation, regardless of whether the window is in an open or closed state (advantageously compared to prior arrangements for mounting the operating mechanism, which generally can only be accessed when the window is open). Should locking system 120 somehow fail to operate with the window locked in the closed position, access to operator mechanism 110*a* may be gained from the interior space by removing bezel 172*a* and screw 218. Moreover, the removable and thus interchangeable bezel and handle arrangement (particularly when color-coordinated) facilitates a system wherein a variety of external or cosmetic effects may be provided, depending on customer preferences (e.g. to match color schemes), without the need for any internal changes to the operator mechanism.

While the locking system has generally been described with reference to embodiments having two locking points (e.g. two strikes and two receivers), a greater number of locking points could be employed without departing from the teachings of this invention. When more than two locking points (e.g. strikes and mating receivers) are employed, according to alternative embodiments, the retaining profiles of the receivers may be conformed to provide for progressive engagement with the associated strikes, typically beginning with the locking point nearest to the operator mechanism and ending with the locking point furthest from the operator mechanism. According to any preferred embodiment, to effect the progressive engagement of the mating strikes and receivers, the receiver closest to the input device (which is engaged first) will have a longer and more gently curved radius at its retaining portion, and subsequently any other receivers (subsequently engaged) will have successively a shorter and more sharply curved retaining portions. In alternative embodiments, subsequent (e.g. middle and upper etc.) receivers may be of identical shape; in such an embodiment, progressive locking may be effected at the first-engaged locking point followed by the simultaneous engagement at all other locking points. According to alternative embodiments, the progressive locking effect could be adjusted by varying the relative center mounting distances between the locking elements (e.g. strikes) on the frame and the mating locking elements (e.g. receivers) on the sash in any operable arrangement that allows complete engagement of all locking elements in the fully-locked position. In other embodiments, all locking elements can be configured to resemble receivers which are oriented to progressively engage one another along their respective retaining profiles.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of the invention as defined in the following claims. In the claims, each means-plus-function clause is intended to cover the structures described herein as performing the recited function and not only structural equivalents but also equivalent structures.

Other substitutions, modifications, changes and omissions may be made in the design, operating conditions and arrangement of the preferred embodiments without departing from the spirit of the invention as expressed in the appended claims.

What is claimed is:

1. An apparatus for locking a window having a frame and a sash movable relative to the frame, which comprises:

a first receiver adapted to be mounted to the sash and a second receiver mounted to the sash, the first receiver having a retaining profile;

a lockbar coupled to the frame and selectively movable between a locked position and an unlocked position;

a first strike mounted to the lockbar and a second strike mounted to the lockbar;

an input device coupled to the lockbar adapted to selectively move the lockbar between a locked position and an unlocked position; and at least one track slidably retaining the lockbar, the at least one track being provided with a slot through which passes at least one of the strikes, the slot having at least one detent arrangement near at least one of its ends which at least partially resists movement of the strike as the strike is moved to the end of the slot;

whereby progressive locking of the sash to the frame is developed as the lockbar is moved from the unlocked position to the locked position, the first strike being progressively engaged and retained along the retaining profile of the first receiver, progressive locking continuing as the second receiver engages the second strike.

2. The apparatus of claim 1 wherein the input device comprises an operator mechanism and a transmitting device coupled between the operator mechanism and the lockbar for translating an input movement of the operator mechanism in a first direction into an output movement of the lockbar in a second direction.

3. The apparatus of claim 2 wherein the transmitting device is configured to translate a generally horizontal input movement into a generally vertical output movement.

4. The apparatus of claim 2 wherein the transmitting device comprises a guide mounted to the window frame and a tape having a first end and a second end adapted for slidable movement within the guide, the first end of the tape being coupled to the operator mechanism and the second end of the tape being coupled to the lockbar.

5. The apparatus of claim 4 wherein the guide is adapted to be located at a lower corner of the window frame.

6. The apparatus of claim 1 further comprising means for transmitting a locking force at the input device.

7. The apparatus of claim 1 wherein the first receiver is a keeper.

8. The apparatus of claim 5 wherein the operator mechanism includes a handle.

9. The apparatus of claim 1 wherein the input device is adapted to be secured in a frame opening in the frame by at least one fastening device accessible from outside of the frame when the window is closed.

10. The apparatus of claim 9 wherein the input device has a base which engages an inside surface of the frame and a mounting plate which engages an outside surface of the frame wherein the at least one fastening device secures the base and the mounting plate against the inside and outside surfaces respectively of the window frame.

11. The apparatus of claim 9 wherein the input device includes a handle, and the at least one fastening device and the frame opening are adapted to be covered by a bezel having a bezel opening in which projects the handle.

12. The apparatus of claim 1 wherein the at least one track comprises two tracks, each track having a detent arrangement.

13. An apparatus for locking a window having a frame and a sash movable relative to the frame, which comprises:

a first receiver adapted to be mounted at a lower end of the sash and a second receiver adapted to be mounted at an upper end of the sash, the first receiver having a first retaining profile and the second receiver having a second retaining profile;

a lockbar adapted to be coupled to the frame and selectively movable between a locked position and an unlocked position;

a first strike mounted to the lockbar adapted to be installed at a lower end of the frame and a second strike mounted to the lockbar at an upper end of the frame;

an operator mechanism coupled to the lockbar adapted to selectively move the lockbar between the locked position and the unlocked position;

translating means mounted between the operator mechanism and the lockbar for translating a generally horizontal input movement of an output link of the operator mechanism in a first direction into a generally vertical output movement of the lockbar in a second direction; and wherein at least a portion of the first retaining profile is arcuate with a first radius and at least a portion of the second retaining profile is arcuate with a second radius;

whereby continuous locking of the sash to the frame is developed as the lockbar is moved from the unlocked position to the locked position, the first strike being engaged with, received, and retained along the retaining profile of the first receiver, continuous locking continuing as the second receiver engages and retains the second strike while the first strike is still engaged with the arcuate portion of the first retaining profile.

14. The apparatus of claim 13 wherein the translating means comprises a guide mounted to the window frame and a tape having a first end and a second end adapted for slidable movement within the guide, the first end of the tape being coupled to the output link of the operator and the second end of the tape being coupled to the lockbar.

15. The apparatus of claim 14 wherein the guide is formed of a plastic material.

16. The apparatus of claim 13 wherein the second receiver has a generally arcuate retaining profile.

17. An apparatus for locking a window having a frame and a sash, the sash having a first end and a second end and being movable with respect to the frame between a closed position wherein a coacting edge of the sash is drawn to a coacting edge of the frame and an open position wherein the coacting edge of the sash is separated from the coacting edge of the frame, which comprises:

a first receiver adapted to be mounted near the first end of the coacting edge of the sash and a second receiver adapted to be mounted near the second end of the coacting edge of the sash, the first receiver having a first retaining profile and the second receiver having a second retaining profile;

a lockbar adapted to be coupled to the coacting edge of the frame and selectively movable between a locked position and an unlocked position;

a first strike mounted to the lockbar near the first end a second strike mounted to the lockbar near the second end of the coacting edge of the sash;

an input device including a handle coupled to the lockbar adapted to selectively move the lockbar between the locked position and the unlocked position; and wherein at least a portion of the first retaining profile is arcuate with a first radius and at least a portion of the second retaining profile is arcuate with second radius, the second radius being shorter than the first radius;

whereby progressive locking is developed as the lockbar is moved from the unlocked position to the locked position, the first strike being engaged with and progressively received and retained along the retaining profile of the first receiver, progressive locking of the first strike and first receiver continuing as the second strike is received and retained along the retaining profile of the second receiver.

18. The apparatus of claim 17 wherein the input device further comprises translating means mounted between the operator and the lockbar for translating an input movement in a first direction into an output movement of the lockbar in a second direction.

19. The apparatus of claim 18 wherein the translating means is adapted for translating a generally horizontal input movement into a generally vertical output movement.

20. The apparatus of claim 18 wherein the translating means comprises a guide mounted to the window frame and a tape having a first end and a second end adapted for slidable movement within the guide, a first end of the tape being coupled to the output link of the input device and a second end of the tape being coupled to the lockbar.

21. The apparatus of claim 17 wherein the first strike comprises a pin.

22. The apparatus of claim 17 wherein the first receiver is made of a metal material.

23. The apparatus of claim 17 wherein the first strike and the second strike are substantially identical in shape.

24. The apparatus of claim 13 wherein the first radius is of a different length than the second radius.

25. The apparatus of claim 24 wherein the first radius is longer than the second radius.

* * * * *